United States Patent [19]

Nixon

[11] 4,408,089

[45] Oct. 4, 1983

[54] EXTREMELY LOW-ATTENUATION, EXTREMELY LOW RADIATION LOSS FLEXIBLE COAXIAL CABLE FOR MICROWAVE ENERGY IN THE GIGAHERTZ FREQUENCY RANGE

[76] Inventor: Charles E. Nixon, 224 Edwards Ave., Sayville, N.Y. 11782

[21] Appl. No.: 271,770

[22] Filed: Jun. 9, 1981

Related U.S. Application Data

[63] Continuation-in-part of Ser. No. 95,179, Nov. 16, 1979, abandoned, which is a continuation of Ser. No. 970,191, Dec. 18, 1978, abandoned, which is a continuation of Ser. No. 842,072, Oct. 14, 1977, abandoned.

[51] Int. Cl.[3] ..... H01B 11/18

[52] U.S. Cl. ..... 174/34; 174/36; 174/106 R; 174/108; 333/96; 333/243

[58] Field of Search ..... 333/96, 243; 174/36, 174/106 R, 107, 108, 109, 110 FC, 34

[56] References Cited

U.S. PATENT DOCUMENTS

| | | | |
|---|---|---|---|
| 1,781,092 | 11/1930 | Affel | 174/108 X |
| 2,212,360 | 8/1940 | Aken | 174/108 X |
| 3,334,177 | 8/1967 | Martin | 174/36 X |
| 3,340,353 | 9/1967 | Mildner | 174/36 X |

FOREIGN PATENT DOCUMENTS

| | | | |
|---|---|---|---|
| 1023367 | 3/1966 | United Kingdom | 174/106 R |

OTHER PUBLICATIONS

Carr Fastener Co., Plaxial New Product Bulletin, 'Miniplax Microminitiature Coaxial Cable', Jul. 1968.

*Primary Examiner*—R. R. Kucia

*Attorney, Agent, or Firm*—Parmelee, Bollinger & Bramblett

[57] ABSTRACT

An extremely low-attenuation, and extremely low radiation loss, flexible coaxial cable for microwave energy in the high gigaHertz (GHz) frequency range includes a solid single-strand, smooth, silver-plated center conductor surrounded by a flexible dielectric medium with a plurality of longitudinal, parallel, contiguous conductive strands adjacent to the low-loss dielectric medium for defining the inner surface of the outer conductor concentric about the center conductor. Each of these strands is smooth silver plated. All of these strands run parallel one to another extending longitudinally of the cable, and they are sufficiently numerous for forming at least two full layers of these strands surrounding the dielectric medium. The inner layer of strands is contiguous to the dielectric medium, and the next layer comprises strands nesting in the valleys defined by the respective neighboring strands of the inner layer. These parallel strands are retained tightly embraced against the dielectric medium and against each other by a continuous, uniform, tightly fitting, squeezing wrapping serving of strong, fine filaments or fibers which are wound tightly around the conductive strands of the outer conductor. An outer jacket of flexible impermeable material, such as plastic, surrounds the wrapping serving for protecting the cable.

9 Claims, 4 Drawing Figures

EXTREMELY LOW-ATTENUATION, EXTREMELY LOW RADIATION LOSS FLEXIBLE COAXIAL CABLE FOR MICROWAVE ENERGY IN THE GIGAHERTZ FREQUENCY RANGE

RELATED APPLICATIONS

This application is a continuation-in-part of copending application Ser. No. 095,179, filed Nov. 16, 1979, which is a continuation of application Ser. No. 970,191, filed Dec. 18, 1978 which is a continuation of application Ser. No. 842,072, filed Oct. 14, 1977 all now abandoned.

BACKGROUND OF THE INVENTION

This invention relates to coaxial electric cables, and more particularly to flexible coaxial cables suitable for carrying microwave signals with extremely low attenuation and extremely low radiation loss.

In a conventional coaxial cable, a center conductor is surrounded by a dielectric which is in turn surrounded by an outer conductive shield serving as the outer conductor generally coaxial with the center conductor. In conventional flexible coaxial cables, this outer shield is formed by a braid of electrical wires. In some flexible cables a second braided shield surrounds the first and the composite is called a double shield braid.

Coaxial cables with such braided shields are suitable for lower frequency applications. However, at higher frequencies, i.e. above approximately 10 gigaHertz (GHz) the attenuation per hundred feet of length of such conventional flexible coaxial cables becomes unacceptable for many communicative applications. For example, in a standard Mil. Spec. RG142-Type cable with a double shield braid having a 50 ohm impedance the loss is approximately 62 decibels (dB) per 100 feet at 10 gigaHertz, and if the frequency were to be increased further up to 12.4 GHz, the attenuation for such conventional double braided coaxial cable might rise to as high as approximately 80 dB per 100 feet. This unduly high attenuation makes conventional braided coaxial cables, even those with double shield braid, unsuitable for high frequency applications much above 10 GHz. In fact, this effective frequency limitation for such conventional braided coaxial cable is so well know and accepted in practice that catalogue information thereon does not go above approximately 12.4 GHz.

Another problem with conventional braided shield coaxial cable is that the cross-over regions where the strands of the braid weave over-and-under each other create "windows" or openings in the braid through which electrical energy "leaks" or radiates away from the cable. In other words, because of such windows or openings, the braided shield covers significantly less than 100% of the area of the outside surface of the dielectric medium. Even when multiple braid layers are employed, the signal can leak out through the windows in the inner braid layer, travel along between the braid layers and then leak out through the windows in the outer braid layer. Also, such windows allow "crosstalk" to occur between neighboring cables carrying different signals; that is, some of the signal energy leaks or radiates out of a first cable and into a second cable, thereby mixing with the signal being carried by the second cable. This crosstalk problem can be serious if the energy level of the signal in the first cable is much higher than that of the signal in the second cable.

A further problem with conventional braided shield coaxial cable is that during flexing the individual strands in the cable move or shift in position with respect to their neighbors, thereby creating rubbing contact which generates electrical noise including high frequency components of noise which undesirably mix with the signal being carried by the cable.

Attempts have been made to defeat leakage and radiation losses and crosstalk by including one or more layers of conductive foil or conductive coated Mylar associated with the layers of the multiple shield braids comprising the outer conductor. The inclusion of such foil does reduce the effects of leakage, radiation loss and crosstalk, but the resultant cable is increased in diameter and is relatively stiff and fragile, being subject to failure by rupture tearing or creasing of the foil. Moreover, the resultant increase in diameter causes the use of more silver-plated copper wire to form the braid layers.

There is a semi-rigid type of coaxial cable which is used in transmitting high frequency signals. Such semi-rigid type cables generally include a cylindrical copper tube as the outer conductor. Such cables lack the flexibility of the braided coaxial cables, but they do provide a lesser attenuation, for example, about 60 db at 18 GHz for a 50 ohm, Mil. Spec. 141-Type semi-rigid coaxial cable with a tubular copper shield.

SUMMARY

Among the many advantages of the present invention are those resulting from the fact that (1) it provides a coaxial cable having flexibility comparable to that obtained in conventional braided shield cables, and (2) also advantageously having a reduced attenuation which is at least comparable to that now provided by conventional semi-rigid coaxial cables in use today having cylindrical, copper tube shields.

It is among the further advantages of a flexible coaxial cable embodying the present invention that it provides an attenuation at a high frequency of 18 GHz which is equal to that provided by a conventional semi-rigid coaxial cable in use today.

Other advantages of a flexible coaxial cable embodying this invention result from the fact that the parallel conductive elements comprising the inner surface of the outer conductor effectively provide a shielding coverage approaching close to 100% of the area of the outside surface of the dielectric medium thereby reducing radiation leakage and crosstalk to extremely low levels.

The coaxial cable embodying the present invention is stable mechanically and electrically. The individual parallel conductive strands in the shield layer are held firmly in place and do not shift or more relative to each other and, therefore, the electrical noise which significantly occurs during flexing of shield braid-type flexible cables is insignificant in cables embodying this invention. In addition, a cable embodying this invention is electrically stable such that its electrical characteristics do not significantly change during flexing, as seen by observing a time domain reflectometer test scope during the flexing test while the cable is carrying microwave energy in the GHz frequency range.

In accordance with the invention in one of its aspects, an extremely low-attenuation, extremely low-radiation loss, flexible, coaxial cable for microwave energy in the high GHz range includes a solid single-strand, smooth, silver-plated center conductor surrounded by a flexible dielectric medium with a plurality of longitudinal, parallel, contiguous conductive strands adjacent to the low-loss dielectric medium for defining the inner surface of the outer conductor concentric about the center conductor. Each of these strands is smooth silver plated. All of these strands run parallel one to another extending longitudinally of the cable, and they are sufficiently numerous for forming at least two full layers of these strands surrounding the dielectric medium. The inner layer of strands is contiguous to the dielectric medium, and the next layer comprises strands nesting in the valleys defined by the respective neighboring strands of the inner layer. These parallel strands are retained tightly embraced against the dielectric medium and against each other by a continuous, uniform, tightly fitting, squeezing wrapping serving of strong, fine filaments or fibers which are wound tightly around the conductive strands of the outer conductor. An outer jacket or flexible impermeable material, such as plastic, surrounds the wrapping serving for protecting the cable.

Although it is theoretically preferred to have the parallel conductive strands comprising the outer conductor extending exactly longitudinally of the coaxial cable, it is the presently preferred mode to have them arranged in a very, very long helical lay for assuring uniform distribution of these strands around the dielectric medium.

In accordance with other aspects of the invention, the parallel conductive elements are held adjacent one to another and are retained tightly embraced against the dielectric medium by a continuous, uniform, tightly fitting wrapping or serving or strong, fine filaments or fibers. For optimum cable performance, this wrapping or serving should be tightly wound snug around the conductive strands and comprises strong, fine-filaments or fibers of material capable of withstanding the heat curing temperature of the jacket.

In summary, this invention provides unprecedently superior performance in respect to attenuation loss, leakage, crosstalk, noise generation, and mechanical and electrical stability as compared with conventional double-shield braid coaxial caable, while utilizing markedly less silver-plated copper wire for forming the shield.

BRIEF DESCRIPTION OF THE DRAWINGS

The foregoing and other objects, features and advantages of the invention will be apparent from the following more particular description of preferred embodiments of the invention, as illustrated in the accompanying drawings in which like reference numerals indicate like parts throughout the different views. The drawings are not necessarily to scale, emphasis instead being placed upon illustrating the principles of the invention.

DESCRIPTION OF PREFERRED EMBODIMENTS OF THE INVENTION

Figure 1:
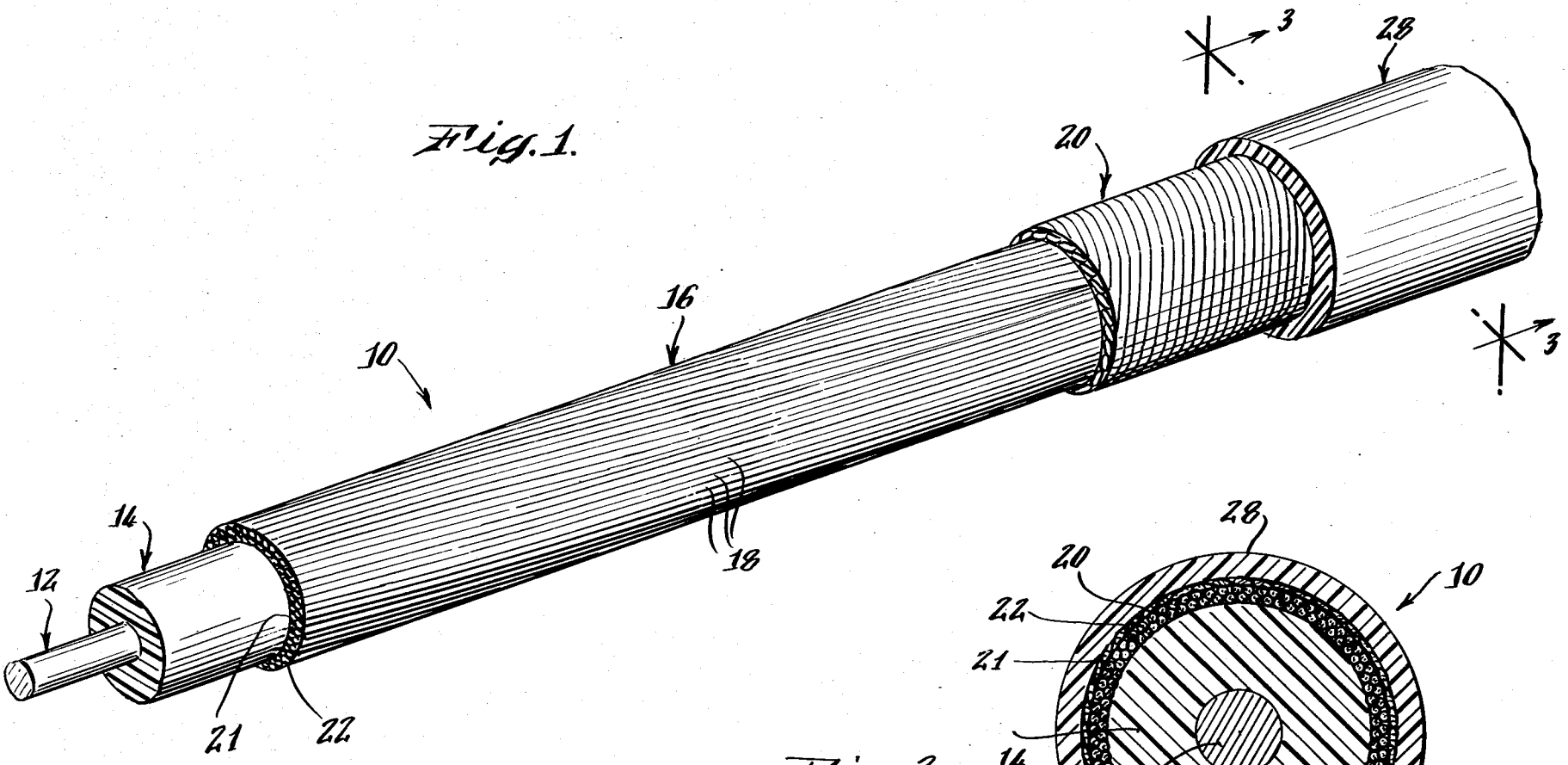
FIG. 1 is a perspective view, greatly enlarged, of a coaxial cable embodying the invention, with portions of the cable layers being shown removed and illustrating the outer conductor of parallel wire strands extending longitudinally of the cable and showing the fine filament wrapping or serving which is wound into tight fitting relationship surrounding the parallel conductive elements.

An understanding of this invention may be helped by a presentation of my theory as to why there is an increasing attenuation occurring in conventional coaxial cables with increasing frequency of the transmitted signals. It is believed that with increasing frequency of the signals the current flowing through the central and outer conductors migrates to the surface regions of the conductors. This confining of the current flow to the surface regions of the conductors is caused by electromagnetic effects occurring at increasing frequencies and is often called the "skin effect". It is inevitable that the attenuation will rise with increasing frequency because the "skin effect" becomes increasingly pronounced with increasing frequency; however, regardless of whether my theory is correct, this invention does produce remarkable improvements.

It is my theory that the less discontinuities there are in the conductor surface oriented transverse to the direction of current flow, then the easier it is for the current to flow in the skin so-to-speak, and the less is the attenuation. The crossings of braid wires in a braided shield in accordance with my theory can be seen as discontinuities or windows in the inner surface of the outer conductor, where the crossing wires are pushed away from each other in the transitions of the braid and are lifted away from the dielectric. I have noted that even in the most closely compacted braided shield, the braided wires only cover about 95% of the area of the dielectric surface, and the remaining numerous, small uncovered spaces act as windows through which some of the energy from the transmitted signals leaks out of the cable and is radiated into the environment. This leakage of energy increases greatly with increasing frequency and contributes to the overall attenuation occurring in the transmission of signals along the coaxial cable.

Furthermore, with respect to the orientation of discontinuities in the outer conductor of a coaxial cable it is to be noted that the current flow is longitudinal along the inner and outer conductors. I have noted what I believe to be an important significance of the fact that longitudinally-running imperfections such as hair-line cracks running longitudinally along a copper tube of a semi-rigid coaxial cable appear to have a very much less attenuating effect on the transmission of high frequency signals than do transverse cracks of comparable size. It is my theory that the diagonally oriented wires in a shield braid (which may lie at an angle approaching 45° to the length of the cable) act as numerous discontinuities, that these diagonal discontinuities can be resolved by vector analysis into transverse and longitudinal discontinuity components, and that it is the transverse discontinuity components which have a very deleterious effect in attenuating the transmitted signals, said adverse effect increasing markedly with increasing frequency because the transverse discontinuities allow for more leakage and other losses to occur with increasing frequency. Also, the tendency for relatively poor contacts, plus variations in contact pressures during flexing, plus the aggregate effects of multitudes of transverse discontinuity crossings and transitions in conventional braided shielding increases the resistance losses and other losses in the braided shield and causes noise generation.

Figure 3:
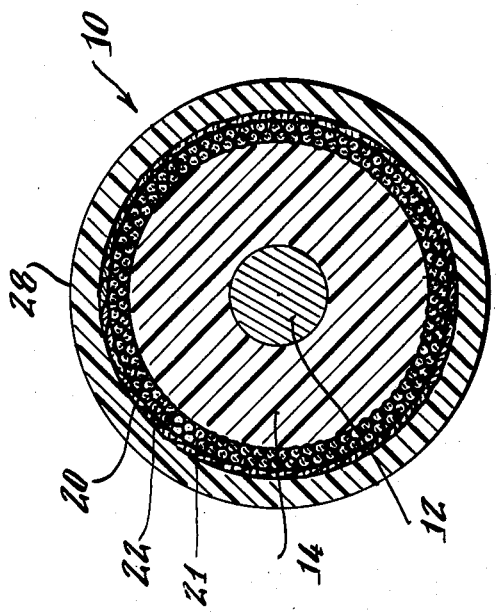
FIG. 3 is a cross section, further enlarged, taken along the plane 3—3 in FIG. 1.

A coaxial cable 10 embodying the present invention is shown in FIGS. 1 and 3. The cable comprises a longitudinal center electrical conductor 12 referred to as the "go" wire in conventional cables in contrast to the outer concentric conductor which is sometimes referred to as the "return" wire. In this preferred embodiment, this center conductor is a solid single-strand wire which is silver plated with a very smooth surface.

This center conductor 12 may be silver-plated copper or silver-plated copper-clad steel, if the center conductor is intended to serve as the pin of a male connector. This center conductor 12 is surrounded by a flexible cylindrical dielectric medium 14, which in this preferred embodiment is fused polytetrafluoroethylene (PTFE), coaxial with the wire 12, because of its low dielectric constant. The dielectric medium 14 is surrounded by an outer conductor 16 coaxial with the center conductor 12 and having a generally circular cylindrical configuration as seen in cross section. This outer conductor is formed by a plurality of conductive elements 18 which in this preferred embodiment are shown as numerous small diameter wire strands extending longitudinally along the cable. All of these longitudinal conductive elements 18 run parallel adjacent one to another.

Ideally, in accordance with my theory for the lowest attenuation, these elements 18 comprising the outer conductor 16 would extend exactly longitudinally; that is, exactly straight and parallel to the longitudinal axis of the cable 10.

However, in order to assure uniform distribution of these strands around the dielectric medium 14, the longitudinal conductive elements 18 are given a very, very slight helical lay, as shown in FIG. 1. The pitch of the very, very slight helical lay of the elements 18; that is the distance along the cable in which a given element 18 will make one complete turn around the core is of the order of one-half to two feet, depending upon the outside diameter (O.D.) of the dielectric medium. In most cases, the pitch of the very slight helical lay of the parallel conductive element 18 is at least nine times greater than the pitch of the wires in a conventional shield braid having a braid angle of 30° relative to the cable length, and preferably, this helical pitch is at least fifty times the inside diameter of the outer conductor 16, where the O.D. of the of the dielectric medium is equal to the I.D. of the outer conductor and has a nominal value 0.116 of an inch, as set forth in the Examples below.

In order to retain these conductive elements 18 firmly pressed in adjacent relationship one to another and tightly embraced against the outside of the dielectric medium, there is a continuous, uniform, tightly fitting wrapping or serving 20. This serving 20 is formed of strong stranded or ribbon material capable of withstanding the heat curing temperature of the plastic jacket, to be described later. For example, this serving is formed of thread, plastic ribbon, metallic ribbon, or wire strands or metallized plastic ribbon, e.g. metallized Mylar. The metallic ribbon or metallized Mylar is employed in order to provide additional shielding against external or internal radiation, if desired, in special applications requiring unusually extreme isolation of the signal being carried in the cable.

In this present embodiment 10, the serving 20 is formed by threads each having a diameter comparable with the diameter of the elements 18. Each thread contains multiple fine filaments, for example glass filaments, with the thread being impregnated with FEP (fluorinated ethylene propylene) or a thread of Nextel filaments (obtainable commercially from 3M Company in Minneapolis, Minn.), with the thread being impregnated with PTFE (polytetrafluoroethylene).

Surrounding this serving 20 is an outer jacket 28 of tough, durable, flexible waterproof material. In this embodiment, the jacket is an 8 mil (0.008") thick jacket of PTFE. For greater mechanical and abrasion resistance, this jacket 24 may be PEEK (polyetheretherketone).

It is preferred for minimizing attenuation that there be a sufficiently large number "N" of the small diameter wire elements 18 that they will at least provide two complete layers 21 and 22 surrounding the dielectric medium 14, as seen by carefully looking at FIGS. 1 and 3. In the inner layer 21, each of the conductive elements 18 is in firm contact with its neighbors on either side. In the next layer 22, each of the conductive elements 18 is nested in the valley between its two underlying neighbors, thereby being in staggered relationship with those underlying ones, thereby tending to block any leakage of the signal out between the respective conductive elements 18 in the innermost layer.

In order to assure that at least two complete layers of the wire strands 18 comprise the outer cable conductor 16, it is usually advisable in actual practice to provide a number "N" of the strands 18 which is slightly larger than the number obtained by geometric calculation to fill out two such layers. The resultant total number "N" of parallel conductive strands 18 are all crowded inwardly into good electrical contact with each other by the tight fitting serving 20.

My presently preferred dielectric medium 14 is a fused PTFE laminate which provides a desirably tough, flexible dielectric with low dielectric constant.

Advantageously, the parallel conductive elements 18 pressed adjacent one to another in contact with one another along their respective lengths provide an effective shielding coverage approaching close to 100% of the area of the outside of the dielectric medium 14. Thus, this flexible coaxial cable 10 provides reduced radiation losses at high as well as at lower frequencies as compared with a conventional flexible coaxial cable having a braided outer conductor, even those having a dual braid shielding. Moreover, when two or more of the coaxial cables 10 are assembled together in an installation there is less "crosstalk" between them as compared with conventional flexible single or dual braided shielded coaxial cables.

Figure 2:
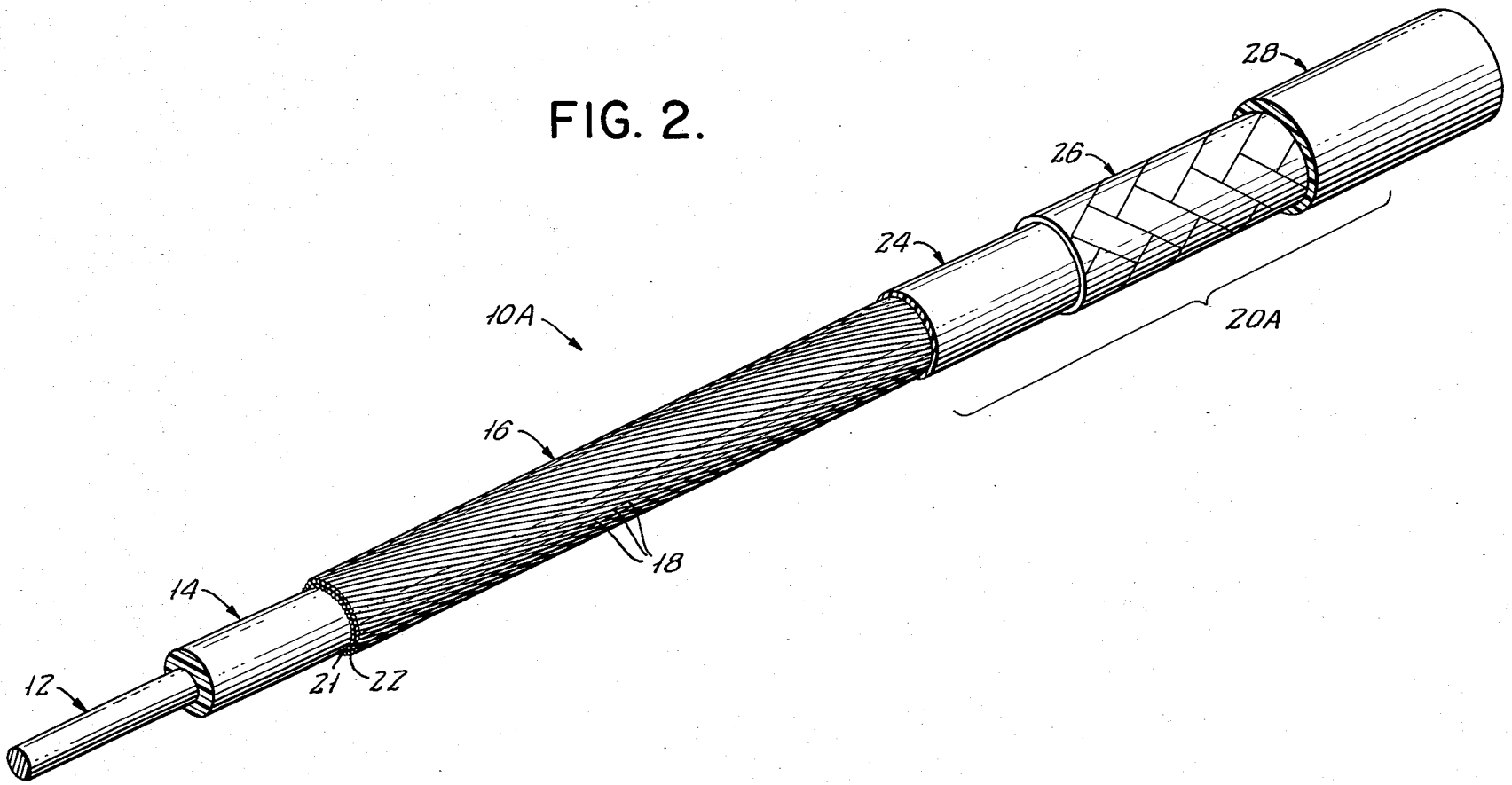
FIG. 2 is a perspective view of another coaxial cable embodiment of this invention, being shown with portions of the cable layers partially removed, and having the parallel, longitudinally extending strands of the outer conductor retained tightly embraced against the dielectric medium by a continuous, uniformly distributed, compressive pressure exerted by a tightly applied outer wire braid acting through an intervening yieldable medium.

A triaxial cable 10A embodying the present invention is shown in FIG. 2. In this cable 10A, the center conductor 12, the dielectric medium 14, the concentric outer conductor 16 are the same as described above for the cable 10. The retainer 20A includes a plurality of layers, as will be explained. Surrounding the longitudinally extending parallel conductive elements 18 is a concentric layer of a yieldable, compressible plastic medium 24. In turn, a tightly applied wire braid 26 surrounds the compressible medium 24 and squeezes it inwardly tightly against these conductive elements. Thus, the intervening compressible medium 24 serves to distribute the squeezing pressure of the wire braid 26 uniformly onto the parallel strands 18 as well as to bed the parallel strands 18 in place and to bed the wires of the braid 26.

In the preferred embodiment as shown in FIG. 2 the compressible medium 24 is unfused PTFE. When the braid 26 is applied tightly (as tightly as reasonably possible without breaking the wires in this braid 26) over the compressible, yieldable plastic medium 24, this plastic is squeezed inwardly driving innermost portions thereof down into the valleys between the outermost parallel strands 18. Thus, the strands 18 become partially embedded into the plastic medium 24 which anchors them in place, which aids in making a coaxial cable having stable parameters. Also, the wires of the braid 26 become partially embedded in the plastic medium.

Although it is possible to heat cure the unfused PTFE material 24 before the very tight braid 26 has been applied, I do not prefer to do so because of the desirable embedment of the strands 18 and of the braid wires which are obtained in the unfused PTFE, as explained above.

In most cases, an outer protective jacket 28 may be applied over the retainer braid 26. This jacket applies an additional retaining squeezing pressure aiding in retaining the conductive elements 18 in place during flexure of the cable 10A. Also, the presence of this jacket 28 protects the braid 26 against attack from ambient conditions and from mechanical scuffing or abrasion in use.

EXAMPLE I

A 50-ohm coaxial cable 10 was constructed with the smooth, silver-plated center conductor 12 (either copper cored or copper-plated steel cored) having an O.D. of 0.036" (American Wire Gage 19), and the dielectric medium 14 had an O.D. of 0.116", thus having thickness of 0.040". The outer conductor 16 had an O.D. of 0.142" being formed by 264 strands of oxygen-free, high conductivity copper wire smooth silver-plated, each strand having a diameter of 0.004" (American Wire Gage 38).

The very, very long helical pitch of these conductive elements 18 was approximately two feet, thereby having a pitch more than 200 times the inside diameter (I.D.) of the outer conductor 16. The particular pitch employed is desirably as long as reasonably possible, keeping in mind that the theoretical optimum is achieved when these strands 18 are longitudinal, parallel with the center conductor, which is an infinite pitch. As explained above, the helical pitch is to assure that the strands 18 are substantially uniformly distributed around the dielectric 14 and this pitch is kept as long as reasonably possible in order to minimize transverse orientation components of the elements 18 for minimizing attenuation loss.

The serving 20 for tightly securing the conductive elements 18 in place comprised eight multi-filament fiber glass threads, each thread being impregnated with FEP and approximating an O.D. of 0.004". The nominal O.D. of the serving 20 was approximately 0.150". The jacket was formed of fused PTFE having a thickness of approximately 0.008" and thereby providing an overall cable diameter of 0.166".

A geometric calculation shows that between 94 and 95 of the wire strands 18 are required to fill the innermost layer 21 of the conductor 16 and between 96 and 97 strands are required to fill the outer layer 22. Thus a value of "N" of 192 is just barely sufficient to assure that at least two full layers 21 and 22 of the conductive strands are provided. In this EXAMPLE I, the total of 264 strands exceeds N value of 192 by 72, which is an excess more than adequate to assure two full layers.

EXAMPLE II

A 50-ohm coaxial cable 10 identical with that described in EXAMPLE I, except that the outer conductor 16 comprises two layers 21 and 22 of wire strands 18 having a total number of 216, which exceeds N (value of 192) by 24, being a reasonably adequate excess to assure two full layers 21 and 22.

EXAMPLE III

A 50-ohm coaxial cable 10A (which can also be used as a triaxial cable) was constructed with the same center conductor 12 as in EXAMPLE I or II, and the same dielectric medium 14 as in EXAMPLE I or II. The outer conductor 16 had an O.D. of 0.140" being formed by 192 strands, thus being equal to N. The longitudinal, parallel, conductive strands 18 were positioned at a very slight helical lay having a pitch of approximately one foot, being equal approximately to 100 times the I.D. of the outer conductor 16. The yieldable, compressible medium 24 was initially 0.008 of an inch thick formed of unfused PTFE, and the retainer braid 26 was applied as tightly as possible. The braid 26 included ten strands of oxygen-free, high conductivity silver-plated copper wire of a diameter of 0.004" (38 AMG) in each bundle of the braid. The jacket 28 was the same as in EXAMPLE I or II.

[End of EXAMPLE III]

A number of variations in the above EXAMPLES are possible. For example, the d/D ratio (namely, ratio of O.D. of inner conductor 12 to I.D. of outer conductor 16) can be kept the same while changing the overall size of the cable for providing 50-ohm cables of various sizes. The larger sizes have more power handling capability and a lower attenuation per unit length. Alternatively, the ratio of the diameter of the center conductor 12 to the I.D. of the outer conductor 16 can be changed (with corresponding changes in thickness of the dielectric 14) for changing the characteristic impedance of the cable.

Leakage can be further decreased somewhat by increasing the number of layers of the conductive elements 18, where overall cable weight is not a factor. Also, the center conductor 12 and conductive elements 18 can be formed of other metal than silver-plated copper, as may be desired for specialized applications involving ambient conditions which would adversely affect silver-plated copper. For example, nickel-plated copper may be used for conductors 12 and 16 where the exposure will be to high temperature or to a methane hydrogen sulphide atmosphere. Where intense mechanical vibration is expected to be encountered, a silver-plated alloy wire (Phelps Dodge Alloy No. 135) may be used rather than copper wire.

From the above examples, it can be seen that ultimate design of the coaxial cable in actual practice is based on a number of variables including permissible cable weight, bulk, signal frequency, degree of flexibility, ambient conditions, and power capacity.

In another variation of the coaxial cable of FIGS. 1 and 2, multiple, parallel, longitudinally extending silver-plated copper ribbons are substituted for the wire strands 18 in the conductor 16. In such a cable, the number of longitudinal discontinuities in the inner surface of the outer conductor 16 are reduced.

Figure 4:
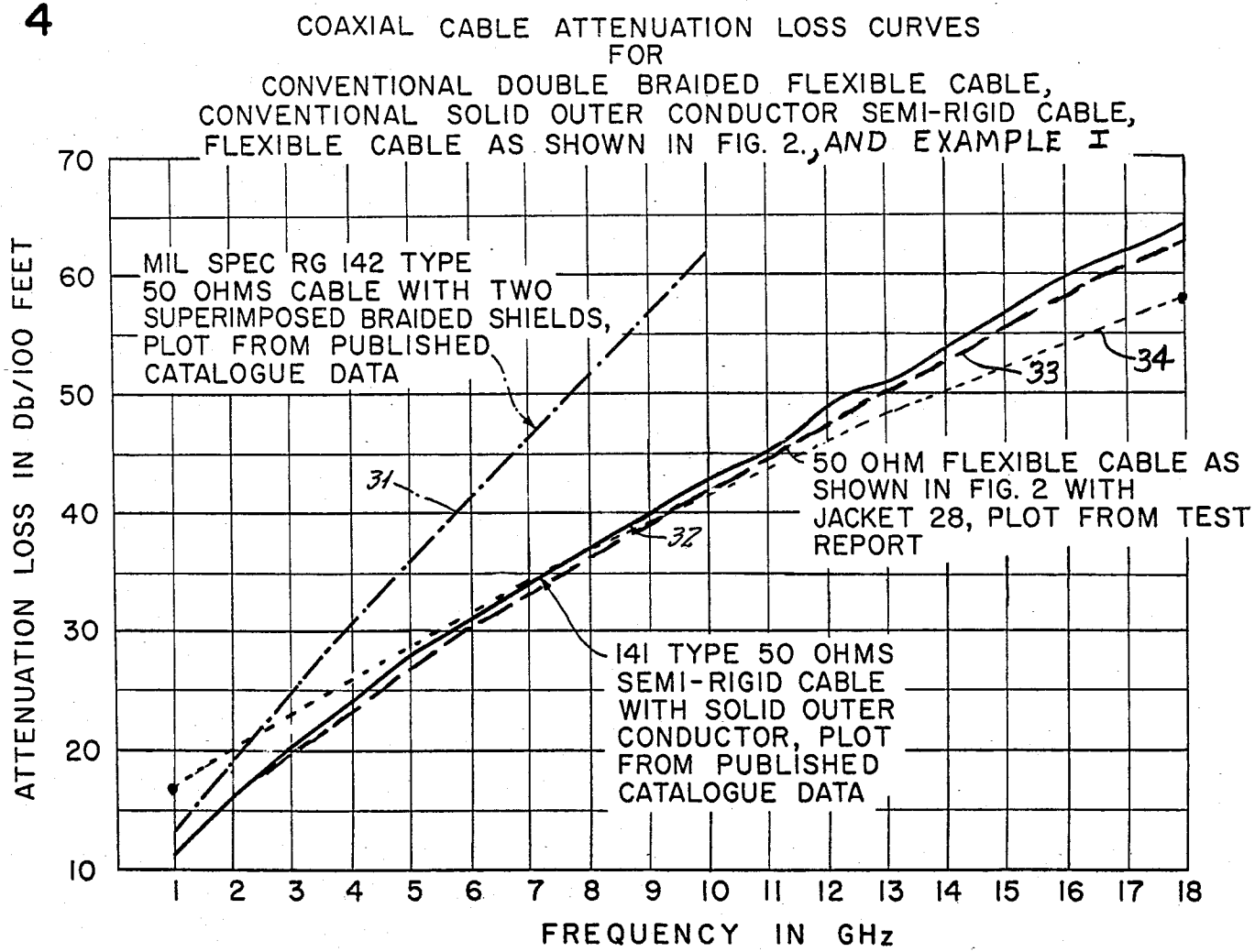
FIG. 4 is a plot showing the attenuation performance up to a frequency of 18 GHz of various types of conventional coaxial cable as compared with a flexible coaxial cable embodying this invention.

Reference will now be made to FIG. 4 which shows plots of attenuation loss in decibels per hundred feet versus frequency in GHz for different coaxial cables. The loss curve 31 is plotted from published catalogue data for conventional Mil. Spec. RG142-Type 50 ohm coaxial cable with two conventional shield braids, one being superimposed directly on top of the other. The second loss curve 32 is also plotted from catalogue data for a conventional 141-Type 50 ohm semi-rigid coaxial cable with a solid cylindrical tubular copper outer conductor. The third loss curve 33 is plotted from a commercial testing laboratory test report for a test made on Sept. 11, 1980, on a coaxial cable embodying the present invention, as described in EXAMPLE III above, having a copper-cored inner conductor 12. The fourth curve 34 is plotted from a test made on June 4, 1981, by an independent test facility on a coaxial cable of EXAMPLE I above, having a copper-cored inner conductor 12. The test was made at the low and high ends of the GHz range, namely, at 2 and 18 GHz (17.3 dB per 100 feet at 2 GHz and 56 dB per 100 feet at 18 GHz). The curve was extrapolated between these two points. The significant aspect to note is that this cable performs exceedingly well at the much more demanding and difficult high frequency end of this range.

Further with respect to FIG. 4, it is to be noted that curves 31 and 32 are nominal in the sense that catalogue values vary somewhat from manufacturer-to-manufacturer and will also vary somewhat from sample-to-sample of the same run of cable.

It is to be noted that each 3 dB improvement represents a reduction by one-half in the power loss.

With reference to the curve 31, such a coaxial cable Mil. Spec. RG 142 Type has an attenuation of 80 dB per 100 feet at 12.4 GHz.

In an effort to improve over this curve 31 performance, I have constructed a 50-ohm double braid coaxial cable having a center conductor and dielectric as described in EXAMPLES I and II using two superimposed braided shields of wire elements of the same size and type of wire (AWG 38 silver plated) as the elements 18. These two braid layers were as closely and tightly braided as possible for minimizing "windows" and were covered with a jacket similar to the jacket 28. This double braid flexible coaxial cable which I made had a loss of 80 dB per 100 feet at 18 GHz.

The inner and outer braid layers of this cable I made had angles of approximately 35° and 43.5°, respectively, relative to the length of the cable. Each braid layer included sixteen groups of ten strands each. Such a cable includes 415,360 feet of silver-plated AWG 38 wire per thousand feet of cable for forming the two braid layers, representing 20.2 pounds per 1,000 feet of cable, of which approximately five percent is silver.

It is to be noted that this 50-ohm double shield braid cable which I made achieved 80 dB per 100 feet at 18 GHz; whereas, the conventional double shield braid cable of curve 31 reaches 80 dB at 12.4 GHz. Moreover, the conventional double braid Mil. Spec. RG 142 Type 50 ohm cable uses sixteen groups of seven strands each in each braid layer of No. 36 AWG wire, and thus uses somewhat more wire than the 50-ohm double shield braid cable.

In marked contrast, the coaxial cable of EXAMPLE II is expected to be comparable in performance to curve 34, or at least not to exceed 65 dB per 100 feet at 18 GHz. This coaxial cable of EXAMPLE II includes 216,200 feet of wire elements 18 per 1,000 feet of cable, weighing 10.5 pounds, of which approximately 5% is silver. This is a savings in copper and silver of 10.5 pounds versus 20.2 pounds per 1,000 feet of cable, namely, approximately 48% with an unprecedented improvement in performance.

While the invention has been particularly shown and described with reference to preferred embodiments thereof, it will be understood by those skilled in the art that various changes in form and detail may be made therein without departing from the spirit and scope of the invention as defined by the appended claims.

I claim:

1. A low-attenuation flexible high frequency coaxial cable capable of use at higher frequencies above 10 gigaHertz comprising:

a center solid single-strand conductor extending longitudinally of the cable along the axis of the cable, a flexible solid dielectric medium surrounding said center conductor, a plurality of longitudinally extending parallel conductive elements adjacent one to another and in electrical contact one with another and adjacent to the outside of said dielectric medium for defining the outer conductor of the coaxial cable concentric to said center conductor and electrically conductively encircling said dielectric medium, said parallel conductive elements comprising at least two layers extending nearly parallel with the length of said cable adjacent one to another and each having a very slight helical lay extending in the same direction about said dielectric medium along the entire length of said cable for assuring that said conductive elements are uniformly distributed around said dielectric medium, means tightly surrounding said outer conductor for retaining said parallel conductive elements tightly pressed against the outside of said dielectric medium and against one another in electrical contact with one another, and an outer jacket over said retaining means.

2. A low-attenuation, flexible high frequency coaxial cable as claimed in claim 1, capable of use at higher frequencies above 10 gigaHertz in which:

said longitudinally extending parallel conductive elements are electrically conductive wire strands in electrical contact one with another, the total number N of the parallel strands is sufficient to form at least two layers thereof closely pressed together in electrical contact with each other and encircling said dielectric medium, and said flexible coaxial cable having a flexibility comparable to that obtained in conventional braided shield cables.

3. A low-attenuation, flexible high frequency coaxial cable as claimed in claim 2 capable of use at higher frequencies above 10 gigaHertz, in which:

the parallel wire strands in the innermost layer of said outer conductor are staggered in position with respect to the parallel strands in the second layer, those strands of the second layer are engaged in firm electrical contact into the respective valleys between the adjacent pair of strands of the innermost layer, and the strands of the second layer have the same pitch as the strands of the innermost layer.

4. A low-attenuation, flexible high frequency coaxial cable as claimed in claim 1, 2 or 3 in which:

the pitch of said very slight helical lay of said conductive elements is at least fifty times the inside diameter of the outer conductor.

5. A low-attenuation, flexible, high frequency coaxial cable as claimed in claim 1, 2 or 3, in which:

said means tightly surrounding said outer conductor is a serving or wrapping of strong material.

6. A low-attenuation, flexible, high frequency coaxial cable as claimed in claim 5, in which:

said serving or wrapping is wound around said outer conductor in the opposite direction relative to said slight helical lay of said conductive elements in said outer conductor.

7. A low-attenuation, flexible, high frequency coaxial cable as claimed in claim 6, in which:

said serving or wrapping is formed of strong filamentary or fibrous material such as fiberglass thread or Nextel fibers or formed of a strong tape material such as Mylar conductively coated on the inside adjacent to the conductive elements of said outer conductor.

8. The flexible, high frequency coaxial cable as claimed in claim 5, wherein said retainer means surrounding said outer conductor comprises a wire braid and a compressible layer interposed between said braid and said outer conductor, said wire braid being tight and pressing inwardly against said compressible layer to anchor said conductive element wire strands in position against said dielectric medium and in firm electrical connection one against another for defining said circular configuration of the outer conductor effectively continuously surrounding said dielectric medium.

9. The flexible, high frequency coaxial cable as claimed in claim 8, wherein said compressible layer is unfused polytetrafluoroethylene.

* * * * *